United States Patent [19]

LaMura

[11] 4,240,640

[45] Dec. 23, 1980

[54] PROJECTILE PENETRATION RESPONSIVE ELECTRICALLY SHORTING TARGET

[75] Inventor: Joseph L. LaMura, West Caldwell, N.J.

[73] Assignee: Joanell Laboratories, Inc., Livingston, N.J.

[21] Appl. No.: 940,348

[22] Filed: Sep. 7, 1978

[51] Int. Cl.[3] ..... F41J 5/04

[52] U.S. Cl. ..... 273/373

[58] Field of Search ..... 273/102.2 A, 373; 200/61.1

[56] References Cited

U.S. PATENT DOCUMENTS

| | | | |
|---|---|---|---|
| 2,576,960 | 12/1951 | McAvoy | 273/102.2 A |
| 3,215,933 | 11/1965 | Scanlon | 273/102.2 A |
| 3,401,939 | 9/1969 | LaMura | 273/102.2 A |
| 3,454,277 | 7/1969 | LaMura | 273/102.2 A |

FOREIGN PATENT DOCUMENTS

| | | | |
|---|---|---|---|
| 2452001 | 6/1976 | Fed. Rep. of Germany | 273/102.2 A |

OTHER PUBLICATIONS

*Engineering Materials*, Alfred White, pp. 260 & 261.

*Primary Examiner*—Anton O. Oechsle
*Attorney, Agent, or Firm*—Howard C. Miskin

[57] ABSTRACT

An electrical, projectile penetration sensing target includes a pair of laminated sheets including a polymer resin coated brittle, calendered aluminum, wire screen and a polymer resin coated, fiberglass web, the laminated sheets being separated by and binded to a sheet of small celled foamed polypropylene. The outer faces of the webs have bonded thereto sheets of the foamed cellular polypropylene. The wire screens are electrically connected to a resistance responsive network whose output is a relatively wide pulse which is coupled to a recording device.

10 Claims, 3 Drawing Figures

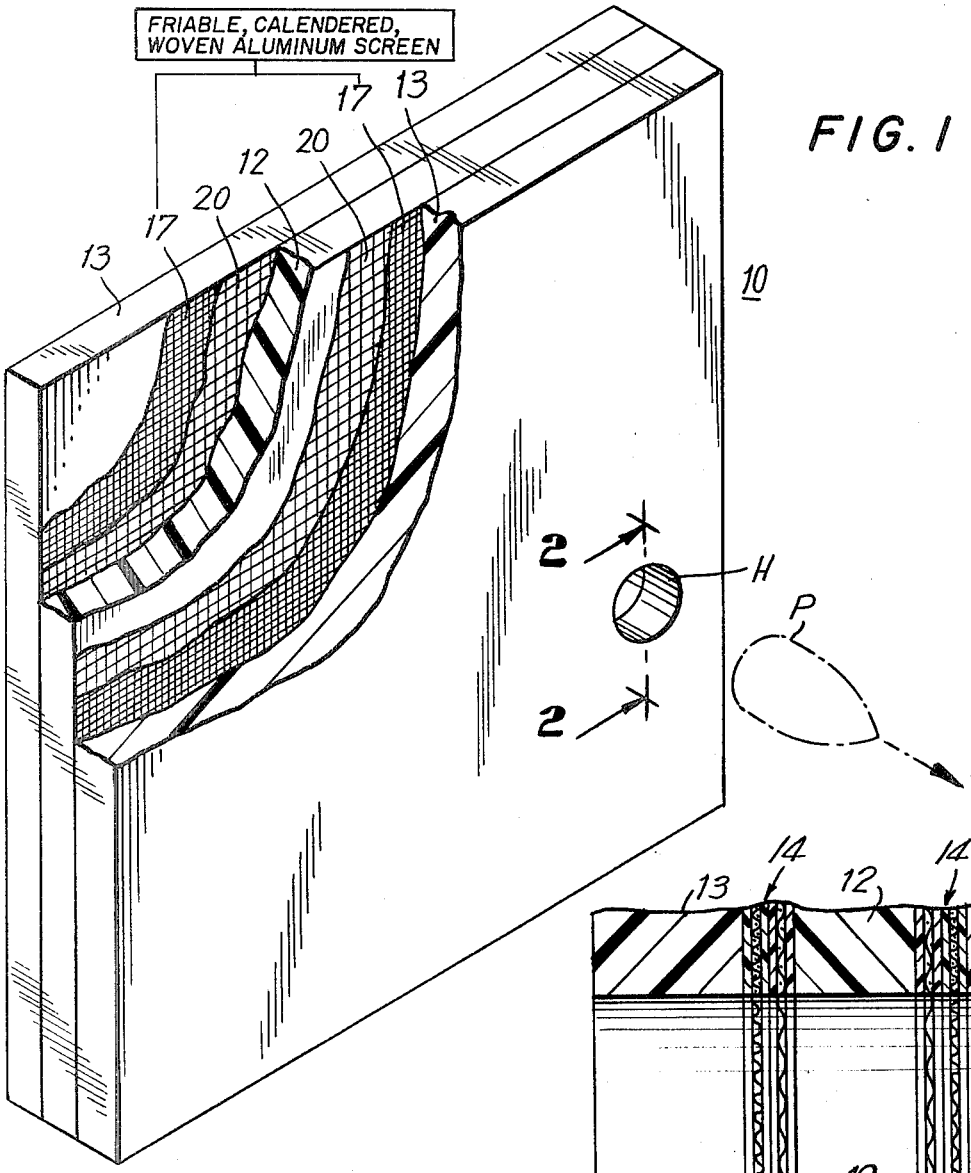
FIG. 1
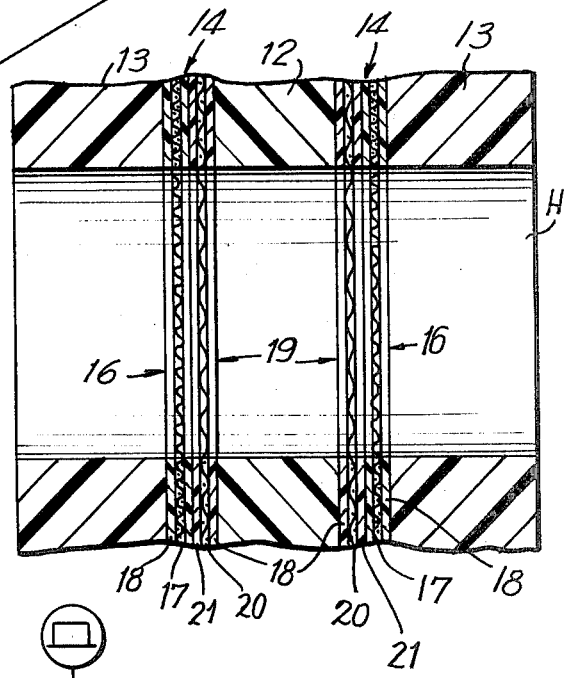
FIG. 2
FIG. 3
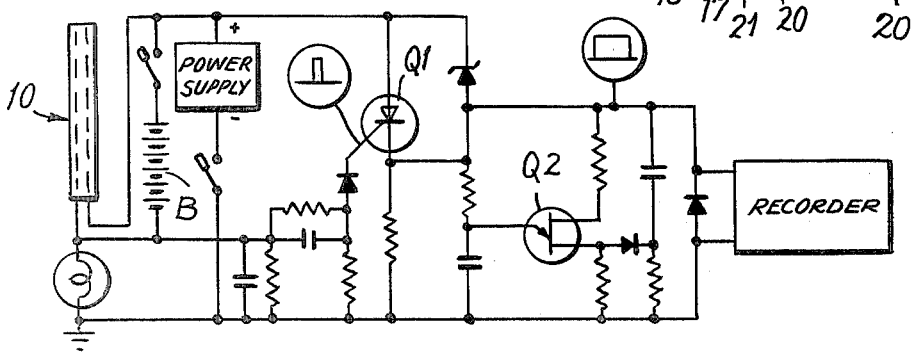

PROJECTILE PENETRATION RESPONSIVE ELECTRICALLY SHORTING TARGET

BACKGROUND OF THE INVENTION

The present invention relates generally to improvements in projectile penetration sensing targets and it relates more particularly to an improved target which produces a sharp momentary drop in the resistance between a pair of terminals when traversed by a projectile.

In U.S. Pat. Nos. 3,401,939 and 3,454,277 granted Sept. 17, 1968 and July 8, 1969 respectively to J. L. LaMura there is disclosed a projectile shorting target of the subject type in which a pair of wire screen electrodes alternate with three foamed polypropylene sheets between which they are successively sandwiched and bonded to form the target. The electrodes are connected to a resistance responsive pulsing circuit whose output is connected to a recorder. While the target devices disclosed in the above identified LaMura patents are generally satisfactory, particularly when employed with small caliber projectiles, such as rifle and pistol bullets and projectiles from various small automatic and semiautomatic weapons, even when the projectiles have thin insulating coatings, they possess important drawbacks and disadvantages, particularly when employed with large caliber projectiles, for example, 105 mm tank gun projectiles, or when struck at high angles of incidence. Under these latter conditions not only is the frequency of shorting between the electrodes after the traverse of the target by a projectile undesirably high necessitating the frequent electrical burning of the shorts or the discarding and replacement of the target but the material removed by the projectile traversing the target and the projectile itself cause excessive and irregular tearing of the exit section of the panel. Accordingly, the earlier target devices of the subject type are of limited application and often unreliable and inconvenient to use and otherwise leave much to be desired.

SUMMARY OF THE INVENTION

It is a principal object of the present invention to provide an improved projectile penetration sensing target.

Another object of the present invention is to provide an improved projectile sensing target which produces a variation in an electrical parameter during the traverse thereof by a projectile.

Still another object of the present invention is to provide an improved projectile penetration sensing target which produces a sharp drop in the electrical resistance between the target output terminal during the projectile's traverse thereof.

A further object of the present invention is to provide a projectile penetration sensing electrical resistance ranging target in which electrical shorting between the sensing electrodes is minimized or obviated and the tearing and removal of target material attendant to projectile traverse is minimized, particularly when used for high caliber projectiles.

Still a further object of the present invention is to provide a device of the above nature characterized by its high reliability and dependability, even when used with high caliber projectiles, its low cost and great versatility and adaptability.

The above and other objects of the present invention will become apparent from a reading from the following description taken in conjunction with the accompanying drawings which illustrate a preferred embodiment thereof.

It has been discovered that in a target of the subject type in which a sheet of an electrically insulating, cellular polymeric resin is sandwiched between a pair of electrode defining metal webs, the electrical shorting between the electrodes following the traverse of the target by a projectile is greatly minimized or prevented by forming at least one of the electrodes of a friable material, that is one that shatters into a particulate or powdered state when subjected to the impact of a projectile on the electrode. In addition, the mechanical properties of the target, particularly its resistance to tearing and material removal by a traversing projectile are greatly reduced by reinforcing the target with a fibrous web, advantageously a glass fiber web.

Accordingly, the present invention contemplates the provision of an improved projectile penetration sensing target comprising a sheet of an insulating material sandwiched between a pair of electrode defining electrically conductive webs, at least one of the electrodes being formed of a friable material which shatters to a divided state where subjected to the impact of a projectile traversing the target. The insulating sheet is advantageously formed of a cellular synthetic organic polymeric resin and reinforced by a fibrous web, and each of the electrodes is formed of a friable metal wire screen, such as calendered aluminum wire screen.

In its preferred form the target includes a middle sheet formed of a fine pore cellular polyolefin, preferably polypropylene, a pair of laminated sheets sandwiching the middle sheet and each including a friable wire metal screen coated with a polymeric resin and a nonwoven fiber glass web, such as a scrim, likewise coated with a polymeric resin and bonded to the resin coated screen, and a pair of fine pore cellular polyolefin outer sheets sandwiching the laminated sheet sandwiched middle sheet, the sheets being bonded at their interfaces. At least the outer faces of the outer sheets preferably have intergrally self-formed skins and are essentially moisture-proof. The two electrodes are advantageously connected to a resistance responsive hit indicating and recording network, for example like those described in the above identified patents.

The improved target devices overcomes the disadvantages and drawbacks of the earlier devices in among other aspects that shorting between the electrodes following the penetration of the target by a projectile is eliminated or greatly minimized, the tearing of and the removal of material by the traversing projectile is reduced and the physical and electrical properties of the target are otherwise improved.

BRIEF DESCRIPTION OF THE DRAWINGS

FIG. 1 is a perspective view, partially fragmented, of a target embodying the present invention, shown following the traverse thereof by a projectile;

FIG. 2 is an enlarged sectional view taken along line 2—2 in FIG. 1; and FIG. 3 is a schematic diagram of a hit indicating and recording network used with the target of FIGS. 1 and 2.

DESCRIPTION OF THE PREFERRED EMBODIMENT

Referring now to the drawings which illustrate a preferred embodiment of the present invention, the reference numeral 10 generally designates the improved target and 11 an electrical resistance responsive hit indicating and recording network employed with the target 10. The target 10, although shown of flat square configuration may be of any desired, suitable configuration and dimensions.

The target 10 includes an intermediate first electrically insulating sheet or panel 12 and a pair of outer second electrically insulating sheets or panels 13 disposed along opposite faces of intermediate sheet 12 and separated therefrom by electrode defining and reinforcing sheets or panels 14 sandwiched between the corresponding confronting faces of successive insulating sheets 12 and 13, the intermediate sheet 12 physically and electrically separating electrode reinforcing sheets 14.

The insulator sheets 12 and 13 are of similar shape and dimensions and are formed of a small cell, cellular synthetic organic polymeric resin, advantageously a foamed or expanded polyolefin, preferably a fine celled foamed polypropylene. Each sheet 12 and 13 is preferably formed with a moisture impervious self skin along its outer face or along all their faces.

Each of the electrode defining reinforcing sheets 14 comprises a laminate of an electrode web 16 and a reinforcing web 19. The web 16 consists of a woven aluminum wire screen 17 which has been calendered whereby to render the aluminum wire friable or brittle so as to shatter under the stress of a projectile impact to a finely divided or particulate state in the area of impact, the friable wire screen being coated with or imbedded in a suitable resin such as Formvar, as at 18. The reinforcing web 19 consists of a fibrous, advantageously glass fiber web 20 which may be nonwoven, for example, a scrim, or may be woven screen or the like, the fibrous web being coated with or imbedded in a suitable synthetic organic polymeric resin, for example PVA, as at 21. A web 16 and a web 19 are superimposed and bonded to each other by a suitable cement or adhesive or by heat fusion, the resin coatings being compatible, to form a laminated electrode reinforcing sheet 14. The superimposed alternating insulating sheets 12 and 13 and electrode sheets 14 are bonded to each other at their respective interfaces, likewise with a suitable cement or adhesive or by heat fusion in the known manner to form the target 10 as an integral unit. The Target 10 is inherently moisture impervious due to the closed cellular structure of the foamed or expanded polyolefin material of insulator sheets 12 and 13. The moisture impervious self-skin on the outer faces only prevents surface moisture entrapment and subsequent contamination.

The indicating and recording network 11 is the same as that described in the above identified patents and operates in the same manner. The electrical parameters may be suitably varied to prevent indicator malfunction under conditions where the target is completely immersed in water with a consequent very low electrical resistance between the electrode screens.

This is accomplished by detection of the rapid change of resistance of projectile penetration of Target 10.

Briefly, the electrode webs or screens 17 are connected to respective input terminals of the resistance responsive network 11 so that the momentary shorting of the metal screens by penetrating projectile effects the application of a sharp short pulse to the control electrode of thyrister Q1 whose output is applied to the input of the pulse forming network including unijunction transistor Q2 which produces a sufficiently broad pulse to actuate the hit recorder which is of conventional construction. The battery B which is employed for burning out shorts between the electrode screens 17 following the projectile traverse of the target 10 may be obviated since such shorting is eliminated.

In accordance with a specific example of the improved target 10 each of the sheets 12 and 13 is formed of fine celled foamed polypropylene and is of a thickness proportioned to the minimum projectile length to be reliably detected, which may be $\frac{1}{4}$ inch thick. The screen 17 is $8\times8$ mesh woven aluminum wire of an initial 0.011 thickness, the screen being calendered to reduce the wire to about 0.005 inch and has a Formvar coating. The fibrous reinforcing web 20 is a 0.020 inch thick fiber glass scrim or a $4\times4$ mesh fiber glass 0.020 thick screen with a PVA coating.

A series of tests were made with the above target in which 105 mm projectiles were fired from a tank cannon at firing angles of 60° and 70° from a down range line perpendicular to the cannon tube and demonstrated that material, foldback, tearing, cracking and shredding were no longer problems in a three dimensional target configuration, that the target was highly resistant to tearing and electrical shorting and was otherwise highly superior to targets of the subject type heretofore available. A projectile P penetrating and traversing the target 10 effects a shorting between wire screens 17 which scratch any insulating coating on the projectile while the projectile traverses the target and leaves in the target a hole H, the wire screens 17 are shattered to a finely divided or particulate state in the cross-sectional area of the hole H, whereby no shorting between the wire screens 17 occurs following the exiting of projectile P. Thus, the necessity and inconvenience of burning out and removing such shorting is virtually eliminated.

While there has been described and illustrated a preferred embodiment of the present invention it is apparent that numerous alterations, omissions and additions may be made without departing from the spirit thereof.

I claim:

1. A projectile penetrating sensing target comprising a first sheet of an electrically insulating polymeric resin and a laminate bonded to each of the opposite faces of said first sheet, each of said laminates including an electrode defining electrically conducting woven friable metal screen shatterable to a divided state in the area of impact by a projectile penetrating said target and a polymeric resin coating each of said screens, and a polymeric resin coated fibrous web superimposed on and bonded to each resin coated metal screen.

2. The target of claim 1 wherein said first sheet is formed of a cellular polymeric resin.

3. The target of claim 2 wherein said resin comprises polypropylene.

4. The target of claim 2 comprising a fiberglass web reinforcing said first sheet.

5. The target of claim 1 wherein said first sheet is formed of a cellular polyolefin.

6. The target of claim 5 including a pair of second cellular polyolefin sheets superimposed on and bonded to the outer faces of said laminates.

7. The target of claim 6 wherein said screens are formed of calendered aluminum wire.

8. A projectile penetrating sensing target comprising a first sheet of an electrically insulating polymeric resin and a pair of electrode defining electrically conducting metal sheets disposed along opposite sides of said first sheet and secured thereto, at least one of said metal sheets being friable whereby to shatter to a divided state in the area of impact by a projectile penetrating said target and comprising a woven aluminum wire screen calendered to reduce the thickness thereof by approximately one-half.

9. A projectile penetrating sensing target comprising a first sheet of an electrically insulating cellular polymeric resin and a pair of panels disposed along the opposite faces of and sandwiching said first sheet and being secured thereto, each of said panels including an electrode defining electrically conducting metal sheet, at least one of said metal sheets comprising a woven, friable metal wire screen and being suffiently friable to shatter to a divided state in the area of impact by a projectile penetrating said target and obviate physical contact between said electrode defining sheets following said projectile penetrating said target.

10. The target of claim 9 wherein the other of said metal sheets comprises a woven, friable metal screen.

* * * * *